United States Patent [19]

Klein

[11] Patent Number: 4,953,509

[45] Date of Patent: Sep. 4, 1990

[54] FORCED-CIRCULATION STEAM GENERATOR

[75] Inventor: Manfred Klein, Oberhausen, Fed. Rep. of Germany

[73] Assignee: Deutsche Babcock Werke Aktiengesellschaft, Oberhausen, Fed. Rep. of Germany

[21] Appl. No.: 373,992

[22] Filed: Jun. 29, 1989

[30] Foreign Application Priority Data

Jul. 6, 1988 [DE] Fed. Rep. of Germany ..... 3822804

[51] Int. Cl.[5] ..... F22B 37/00

[52] U.S. Cl. ..... 122/6 A; 122/235.15; 122/235.11; 122/406.4

[58] Field of Search ..... 122/6 A, 235 D, 235 R, 122/406 S, 7 R, 235 B, 235 A, 235 K, DIG. 4

[56] References Cited

U.S. PATENT DOCUMENTS

| | | | |
|---|---|---|---|
| 3,135,243 | 6/1964 | Schroedter | 122/6 A |
| 3,665,893 | 5/1972 | Barberton et al. | 122/6 A |
| 4,178,881 | 12/1979 | Pratt et al. | 122/235 A |
| 4,244,327 | 1/1981 | Ssinegurski | 122/235 D |
| 4,473,035 | 9/1984 | Gorzegno | 122/235 A |
| 4,665,865 | 5/1987 | Zubrod | 122/235 K |

FOREIGN PATENT DOCUMENTS

| | | | |
|---|---|---|---|
| 819494 | 4/1981 | U.S.S.R. | 122/235 D |
| 298878 | 10/1928 | United Kingdom | 122/235 D |

*Primary Examiner*—Henry A. Bennet
*Assistant Examiner*—Denise L. Ferensic
*Attorney, Agent, or Firm*—Max Fogiel

[57] ABSTRACT

A forced-circulation steam generator with a combustion chamber (1) that has a cone (2), whereby the combustion chamber is demarcated by piping walls with at least partly slanting pipes, the cone is composed of piping walls (9, 10, 11, and 12) with upright pipes, and the pipes in the combustion chamber are separated from the pipes in the cone by headers. The two series of pipes are separated such that the medium flowing through the pipes in the combustion chamber has the same enthalpy.

5 Claims, 3 Drawing Sheets

FORCED-CIRCULATION STEAM GENERATOR

Figure 1:
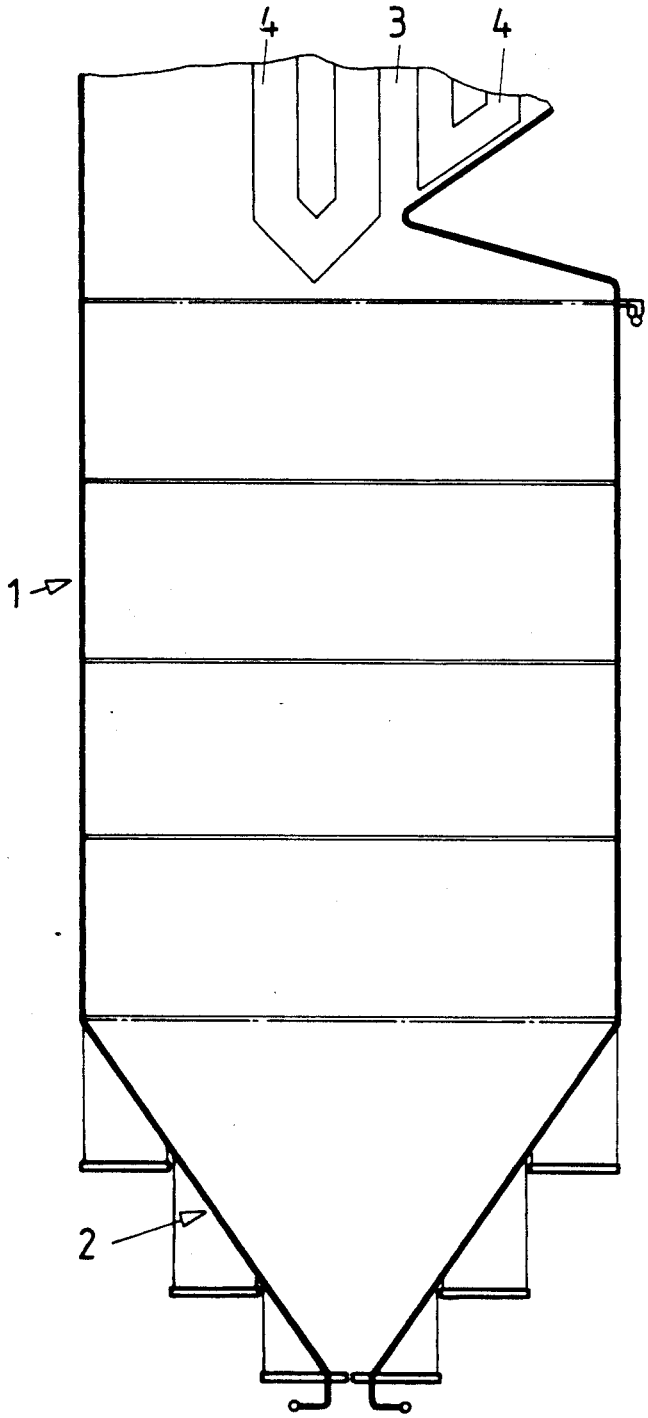

The invention concerns a forced-circulation steam generator with a combustion chamber that has a cone at one end with the characteristics recited in the preamble to claim 1.

The overall design dictates that the geometry of a combustion-chamber cone with perpendicular pipes be irregular, making the heat medium that flows through the pipes absorb heat irregularly during the heating process. The irregular heat absorption occurs in particular when the device is not operating at full capacity, when, that is, only some of the burners, especially those in the vicinity of the cone, are in operation. The situation also occurs when the capacity is increased subject to controls-technology derivative firing. The irregular heating of the medium in the vicinity of the cone propagates into the piping walls, which function as evaporators. The result is varying temperatures in the walls of the combustion chamber.

Counteracting the irregular absorption of heat in the vicinity of the cone by extending the cone pipes out of the wall at a point upstream of where the evaporation occurs is known (German OS 3 207 987). The projecting pipes are extended back into the plane of the wall by way of mixing headers and connectors. Some of the irregular heat absorption in the vicinity of the cone is compensated by a mixing process in the headers.

It has been suspected that the equilibration attained by the measures disclosed in German OS 3 207 987 might not be adequate when, as is now conventional, a forced-circulation steam generator is heated with a fuel that can be allowed to emit only very low levels of nitrogen oxides. To comply with such a standard, the firing can no longer be directed at uniformly heating the piping walls but must be carried out in such a way as to suppress the formation of nitrogen oxides. This low $NO_x$ firing leads to irregular heating of the walls of the combustion chamber and accordingly augments the irregular heat absorption of the medium in the pipes in the vicinity of the cone. In these conditions, a uniform flow through the evaporation pipes can only be attained by increasing the pressure drop in the pipes by means of constrictions.

The object of the invention is to improve the generic forced-circulation steam generator to the extent that the flow through the evaporation pipes will be uniform with no increase in pressure drop even when the generator is fired with a low-$NO_x$ fuel.

This object is attained in accordance with the invention in a generic forced-circulation steam generator fired with low-$NO_x$ fuel by the characteristics recited in the body of claim 1. An advantageous embodiment of the invention is attained by the circulation system recited in claim 2.

The uniform enthalpy that can be attained by extending pipe through the vicinity of the cone and accordingly allowing the medium in the pipes to enter the evaporation section of the combustion chamber allows the medium to evaporate at approximately the same level in every pipe. The medium will accordingly flow uniformly through all the pipes. Any premature evaporation, due for example to irregular heating in the evaporator section, will have no effect upstream of the top, where the drawbacks are considerably less serious.

Figure 2:
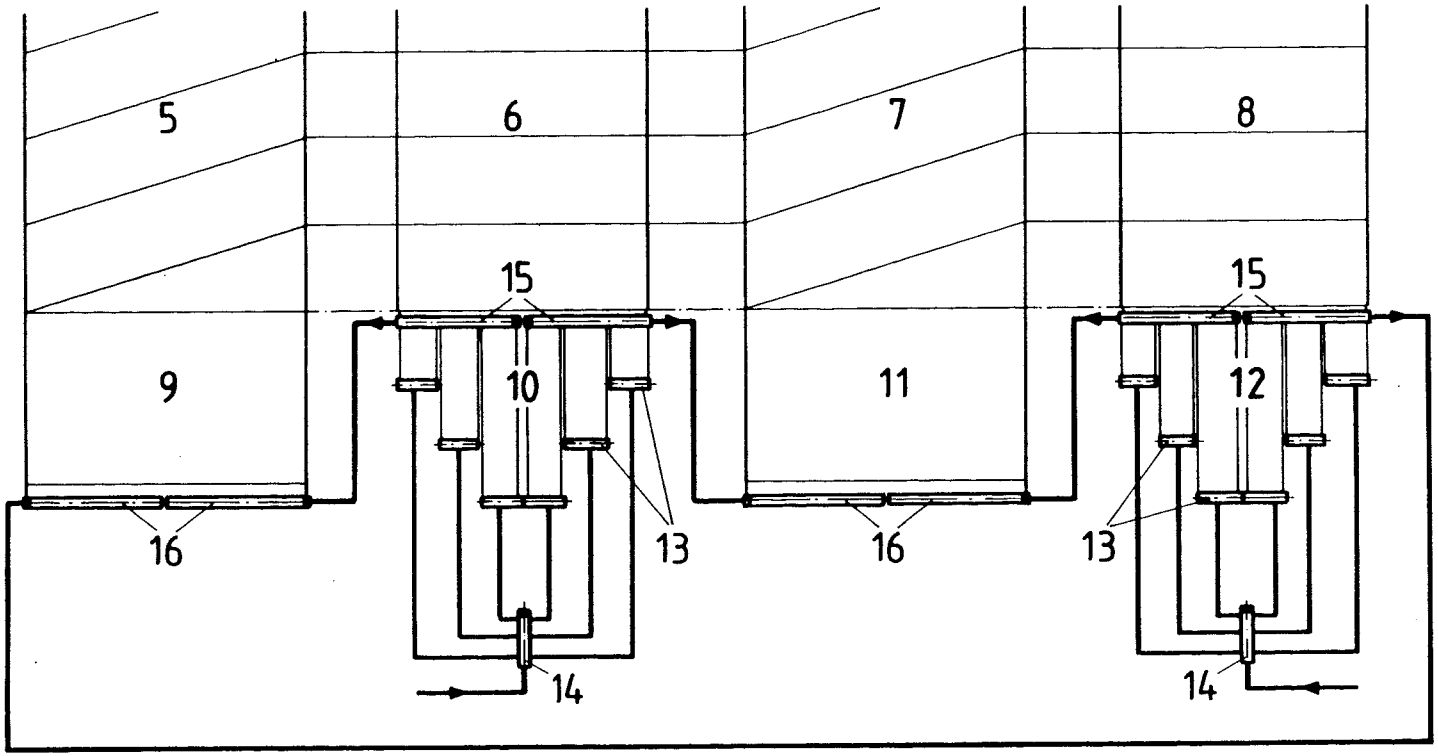
Figure 3:
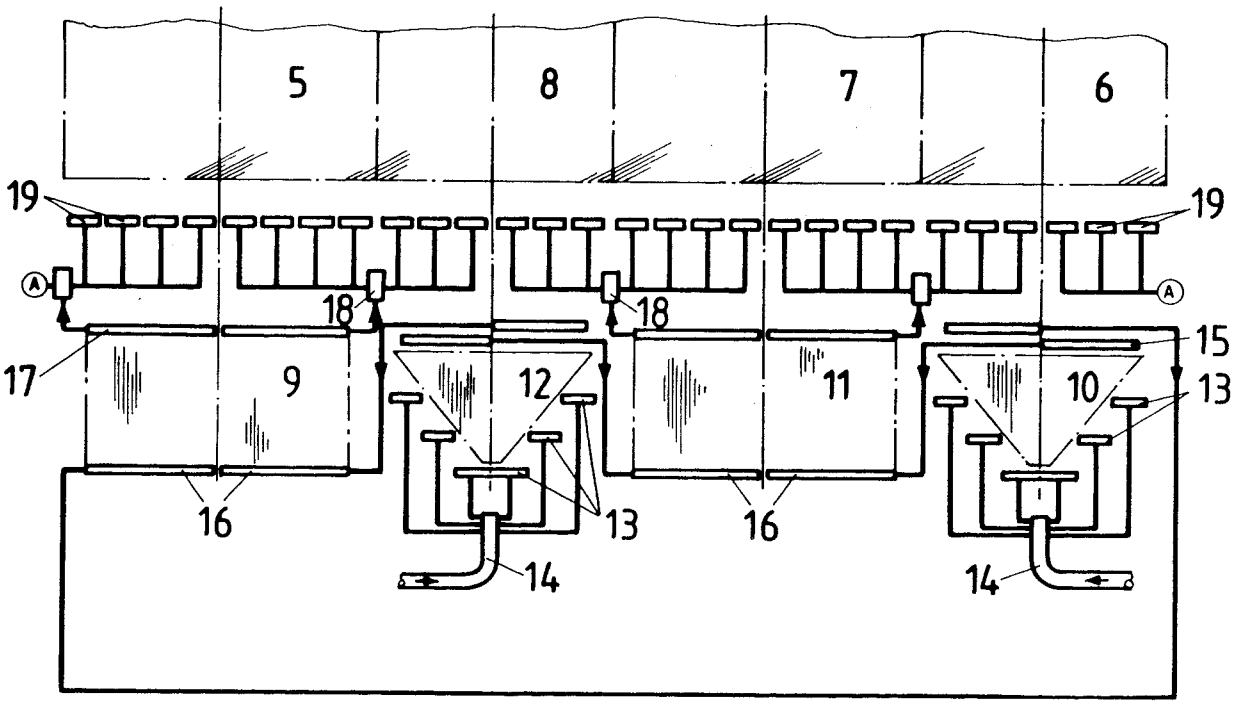

Embodiments of the invention will now be described with reference to the drawing, wherein FIG. 1 is a schematic illustration of part of a forced-circulation steam generator, FIG. 2 illustrates the structure of the walls of the generator illustrated in FIG. 1, and FIG. 3 illustrates the structure of another embodiment.

A forced-circulation steam generator has a combustion chamber 1 heated by burners and merging at the bottom into a cone 2. The generator can be either an upright boiler or a two-pass boiler. In the latter case, combustion chamber 1 communicates through an incompletely illustrated transverse flue 3 with an unillustrated second gas flue. Transverse flue 3 and the second gas flue accommodate clustered flue surfaces 4.

Combustion chamber 1 has four gas-tight piping walls, specifically a front wall 5, a right-hand wall 6, a rear wall 7, and a left-hand wall 8. The pipes in the walls of the combustion chamber slope up in the form of a coil (FIG. 3). It is also possible for only the pipes in front wall 5 and rear wall 7 to slope up, with the pipes in side walls 6 and 8 extending horizontally.

The front wall 9 and rear wall 11 of cone 2 slant, and their length remains constant over the total height. The side walls 10 and 12 of cone 2 are upright and taper down. The pipes in cone 2 are upright. The pipes in side walls 10 and 12 extend out of mutually displaced cone headers 13 that communicate through an unillustrated economizer by way of an intake header 14. The cone pipes open into two outlet headers 15 on each side of the midline of side walls 10 and 12. Each outlet header 15 in side walls 10 and 12 communicates with one of two intake headers 16 in cone front wall 9 and rear wall 11 (FIG. 2). The pipes in front wall 9 and rear wall 11 extend out of intake headers 16 and communicate by way of castings with the sloping pipes in front wall 5 and rear wall 7. The sloping pipes in front wall 5 and rear wall 7 extend into the horizontal pipes in side walls 6 and 8.

When all the walls 5, 6, 7, and 8 of the combustion chamber have sloping pipes (FIG. 3), the pipes in cone front wall 9 and rear wall 11 open into outlet headers 17. Outlet headers 17 communicate with intermediate headers 18 that distribute the medium into intake headers 19, with which the pipes in combustion-chamber walls 5, 6, 7, and 8 communicate.

The aforesaid system of cone walls 9, 10. 11, and 12 ensures that the medium will have approximately the same enthalpy in each pipe as it enters the combustion-chamber walls 5, 6, 7, and 8 that constitute the evaporator.

What is claimed:

1. A forced-circulation steam generator comprising: a combustion chamber having a cone; said combustion chamber having piping walls with at least partly slanting pipes; said cone having piping walls with upright pipes; separating header means separating the pipes in said combustion chamber from the pipes in said cone and forming a separating plane; a flow medium from the pipes in said cone to the pipes in said combustion chamber having uniform enthalpy in said separating plane due to said separating header means.

2. A forced-circulation steam generator as defined in claim 1, wherein said cone has downward tapering cone walls with pipes and equal-length cone walls with pipes, the pipes in said downward tapering cone walls communicating with the pipes in said equal-length cone walls; said pipes in said equal-length cone walls communicating also directly with said pipes in said combustion chamber.

3. A forced-circulation steam generator as defined in claim 1, wherein said cone has equal-length cone walls and further header means, and pipes in said equal-length cone walls communicating with said pipes in said combustion chamber through said further header means.

4. A forced-circulation steam generator comprising: a combustion chamber having a cone; said combustion chamber having piping walls with at least partly slanting pipes; said cone having piping walls with upright pipes; separating header means separating the pipes in said combustion chamber from the pipes in said cone and forming a separating plane; a flow medium from the pipes of the cone to the pipes in said combustion chamber having uniform enthalpy in said separating plane due to said separating header means; said combustion chamber functioning as an evaporator, said flow medium being evaporated at substantially the same height in all pipes in said combustion chamber and flowing uniformly through said pipes in said combustion chamber for preventing premature evaporation of said medium, any premature evaporation due to non-uniform heating in the evaporator producing non-uniform evaporation first in an upper part of said piping walls in said combustion chamber and reducing effects from higher pressure losses due to non-uniform flow.

5. A forced-circulation steam generator comprising: a combustion chamber having a cone; said combustion chamber having piping walls with at least partly slanting pipes; said cone having piping walls with upright pipes; separating header means separating the pipes in said combustion chamber from the pipes in said cone and forming a separating plane; a flow medium from the pipes of the cone to the pipes in said combustion chamber having uniform enthalpy in said separating plane due to said separating header means, said combustion chamber functioning as an evaporator, said flow medium being evaporated at substantially the same height in all pipes in said combustion chamber and flowing uniformly through said pipes in said combustion chamber for preventing premature evaporation of said medium, any premature evaporation due to non-uniform heating in the evaporator producing non-uniform evaporation first in an upper part of said piping walls in said combustion chamber and reducing effects from higher pressure losses due to non-uniform flow, said cone having downward tapering cone walls and equal-length cone walls communicating with said downward tapering cone walls; and further header means, pipes in said equal-length cone walls communicating with the pipes in said piping walls of said combustion chamber through said further header means.

* * * * *